United States Patent [19]

Kuhns et al.

[11] Patent Number: 4,706,355

[45] Date of Patent: Nov. 17, 1987

[54] METHOD OF MAKING AN INTERNALLY GROOVED AND EXPANDED TUBULAR HEAT EXCHANGER APPARATUS

[75] Inventors: John P. Kuhns, Hurst; James R. Taylor, Dallas, both of Tex.

[73] Assignee: Q-Dot Corporation, Garland, Tex.

[21] Appl. No.: 898,414

[22] Filed: Aug. 21, 1986

Related U.S. Application Data

[62] Division of Ser. No. 680,310, Dec. 11, 1984.

[51] Int. Cl.[4] ..... B21D 53/02

[52] U.S. Cl. ..... 29/157.3 C; 29/157.3 A; 29/157.3 B; 29/727

[58] Field of Search ..... 29/157.3 A, 157.3 B, 29/157.3 C, 157.3 U, 726, 727; 165/104.26, 179

[56] References Cited

U.S. PATENT DOCUMENTS

| | | | |
|---|---|---|---|
| 4,044,797 | 11/1975 | Fujie et al. | 138/38 |
| 4,100,963 | 7/1978 | Dillenbeck | 165/17 |
| 4,114,384 | 3/1980 | Fujie et al. | 72/325 |
| 4,118,944 | 6/1977 | Lord et al. | 62/98 |
| 4,142,392 | 3/1979 | Ochiai et al. | 72/113 |
| 4,300,629 | 11/1981 | Hatada et al. | 165/151 |
| 4,440,215 | 6/1981 | Grover et al. | 165/104 |
| 4,480,684 | 12/1982 | Onishi et al. | 165/110 |

FOREIGN PATENT DOCUMENTS

| | | | |
|---|---|---|---|
| 67793 | 10/1980 | Japan . | |
| 0130352 | 10/1980 | Japan | 29/157.3 B |
| 0149737 | 11/1980 | Japan | 29/157.3 B |
| 0019939 | 2/1981 | Japan | 29/157.3 A |
| 0173043 | 10/1983 | Japan | 29/157.3 A |
| 0040624 | 3/1985 | Japan | 29/157.3 A |
| 1523942 | 9/1978 | United Kingdom | 13/04 |
| 1557429 | 12/1979 | United Kingdom | 23/00 |

*Primary Examiner*—P. W. Echols
*Assistant Examiner*—Irene Graves Golabi
*Attorney, Agent, or Firm*—Hubbard, Thurman, Turner & Tucker

[57] ABSTRACT

Heat exchanger tubes and heat pipes are simultaneously radially expanded into engagement with heat transfer fins and provided with internal spiral grooving by a generally spherical shaped tool disposed on the end of an elongated mandrel. The tool comprises a spherical segment having helical teeth formed on the exterior thereof and the tool is mounted for free rotation on the end of the mandrel. In forming a finned tube type heat exchanger a series of platelike fins are disposed in alignment with each other with tube receiving openings formed slightly oversize with respect to the outside diameter of the tube prior to expansion. The tube is supported by the fins and is secured at one end by a suitable device such as an expanding jaw collet connected to a hydraulic cylinder for extending the mandrel through the tube. The tube wall is simultaneously radially expanded into forcible engagement with the fins and spiral ridges with intervening grooves are formed on the interior wall surface of the tube to provide enhanced heat transfer characteristics.

1 Claim, 7 Drawing Figures

METHOD OF MAKING AN INTERNALLY GROOVED AND EXPANDED TUBULAR HEAT EXCHANGER APPARATUS

This is a division of application Ser. No. 680,310, filed Dec. 11, 1984.

BACKGROUND OF THE INVENTION

1. Field of the Invention

The present invention pertains to a heat exchanger apparatus comprising heat exchanger tubes which are internally, spirally grooved and which may be expanded into forcible engagement with one or more heat exchanger fins disposed around the apparatus. A spherical tool is forced through the interior of a tube to simultaneously form spiral internal grooves and expand the tube into forcible engagement with heat exchanger fins.

2. Background

In the art of various types of heat exchanger tubing including arrangements of fin and tube type heat exchangers and heat pipes there have been several efforts to improve the heat exchange capability of the tubing by forming internal, intermittent or continuous grooves to increase the surface area of the inner wall of the tubing and, in certain applications, provide for increasing the turbulence of the fluid flowing through the tubing. In the art of heat pipes, for example, it is known to use a cutting tool to form a continuous spiral groove on the inner surface of the pipe to increase the pipe surface area and to provide a wicking to enhance the capillary action of the fluid which is advantageous in heat pipe operation.

It is also known to provide heat exchanger tubing with various internal structural features to enhance the heat exchange capacity of the tubing. Certain types of structures such as tubulators or fins are relatively complex and difficult to properly install within the tubing. Moreover, these structures are somewhat counterproductive in that, in certain applications fluid pressure loss through the heat exchanger must be minimized, and internal turbulation and heat transfer structures are not conducive to this requirement.

There have also been efforts to provide heat exchanger tubing having longitudinally extending grooves or recesses formed in the inner wall surface to enhance heat exchange capabilities of the tubing. However, known techniques for forming internal grooving in elongated heat exchanger tubes involve the use of complex tooling or tools which otherwise cause certain problems in the tube fabrication process.

Heat exchanger tubes and heat pipes of the general type discussed herein are often used in connection with heat exchanger fin structures formed from relatively thin metal plates which are secured to the tubing to form a heat exchanger core. It is important that substantial contact be made between the exterior surface of the tube and the heat exchanger fin in order to promote good heat transfer between these structures.

One way of accomplishing the formation of a juncture between heat exchanger tubes and the fin structure is to form the fins with slightly oversize holes for receiving the tubes, arranging the tubes and the fins in a fixture and then expanding the tubes into contact with the fins. This type of process must then be followed by an operation to form the tube grooving or to install other types of internal heat exchange or turbulating structure. If the groove forming or other turbulation apparatus installation process is carried out after the expansion of the tube the connection between the tube outer wall surface and the respective fins can be distributed and adversely affected. Moreover, cutting the tube inner wall to form the grooves can result in structural weakening of the tube or penetration of the tube wall if a sufficient wall thickness is not maintained, since the expansion process effectively reduces the wall thickness. Accordingly, there have been longstanding problems associated with the fabrication of internally grooved heat exchanger tubes and particularly for applications wherein the tubes are provided with a plurality of heat transfer fins connected to the outer surface of the tubes.

The present invention overcomes several problems assocated with the manufacture of heat exchange tubes having internal heat transfer grooving and the manufacture of heat exchange apparatus of the fin and tube type.

SUMMARY OF THE INVENTION

The present invention provides an improved heat transfer tube having a unique internal spiral grooving provided in the inner wall surface of the tube for increasing the heat transfer surface area of the tube and for increasing the turbulation of fluid flow through the tube to improve the heat transfer characteristics of the tube and to minimize pressure losses of fluid flowing through the tube.

In accordance with one aspect of the present invention there is provided a relatively thinwalled heat exchanger tube having spiral grooving formed in the inner wall surface thereof which is formed by a somewhat spherical shaped tool head having helical serrations or teeth on the outer spherical surface of the head. The teeth on the tool head are operable to displace portions of the metal of the heat exchanger tube to increase the heat transfer surface area of the tube without reducing the strength of the tube while expanding the tube to have a larger outer diameter.

In accordance with another aspect of the present invention there is provided a heat exchanger apparatus having one or more heat exchange tubes which are formed with internal spiral grooves and are expanded radially into forcible engagement with a plurality of heat transfer members such as heat transfer fins wherein circumferential contact of the tube with the fin structure is assured and a substantially rigid connection between the tube and the fin structure is accomplished in one operation.

In accordance with another aspect of the present invention there is provided a heat exchange apparatus comprising a plurality of heat exchange fluid conducting tubes which are secured to parallel, closely spaced heat exchange fins during an operation wherein the tubes are each expanded into forcible engagement with the fins and spiral grooving is formed in the inner wall surface of the tubes to increase the heat transfer capacity of the tubes by increasing the surface area of the wall in contact with the fluid flowing through the tube and to increase the turbulation of the fluid as it flows through the tube and with minimum pressure loss. Although the term turbulation is used herein to indicate that fluid mixing occurs and a boundary layer of fluid adjacent the wall surface of the tube is reduced it is indicated that the pressure loss through a spiral grooved tube according to the invention is less than for a smooth walled tube with the same flow conditions.

In accordance with still another aspect of the present invention there is provided a heat transfer tube structure having internal spiral grooving formed therein and having a cross-sectional wall configuration which provides improved heat transfer surfaces in the inner wall surface of the tube, provides structure for promoting turbulent flow of the fluid flowing through the tube and providing improved structural strength of the tube wherein an average wall thickness of the tube is less than that required for conventional heat exchanger tubes without sacrificing tube strength or rigidity.

In accordance with still another aspect of the present invention there is provided a method of manufacturing a heat exchanger comprising one or more relatively thinwalled elongated tubes which are connected to a plurality of spaced apart heat transfer fin members to form a heat transfer device wherein the connection between the tube or tubes and the fins is accomplished by a tube expansion process wherein the tube is expanded into engagement with the fin structure and simultaneously formed with internal grooving in the inner wall surface of the tube. By simultaneously forming the internal grooving and expanding the tubes into engagement with the fin structure the overall manufacturing process of the heat exchanger is improved and the steps required to provide internal heat transfer or turbulation features in the tubing and connect the tubing to other sructure are carried out in one operation. The tubing may be formed with continuous spiral grooving of either left or right hand configuration or the tubing may be formed with both left and right hand spiral grooving intersecting the grooving of the other hand to increase the effective heat transfer surface area of the inner wall of the tube and to provide additional turbulation of the fluid flowing through the tube.

In accordance with yet another aspect of the present invention there is provided a unique tool for forming grooves on the interior wall surface of relatively thinwalled heat exchanger tubing characterized by a generally spherical tool member formed with spiral or helical teeth on the outer surface thereof and is mounted on an elongated mandrel or support shaft for extension through an elongated heat exchanger tube to provide the internal grooving in the tube. The groove forming tool is preferably formed as a member having a generally truncated spherical shape with a central bore extending through and co-axial with the central sphere axis and mounted for rotation on a mandrel whereby spiral grooves may be formed in the inner wall surface of a tubular member by forcing the mandrel axially through the tubular member and allowing the tool to rotate and displace the metal of the tube wall. The tool is advantageously provided of a diameter such that the tube is radially expanded as the grooving is being formed.

Those skilled in the art will further appreciate the above described features and advantages of the present invention as well as additional superior aspect thereof upon reading the detailed description which follows in conjunction with the drawing.

DESCRIPTION OF THE PREFERRED EMBODIMENTS

Figure 1:
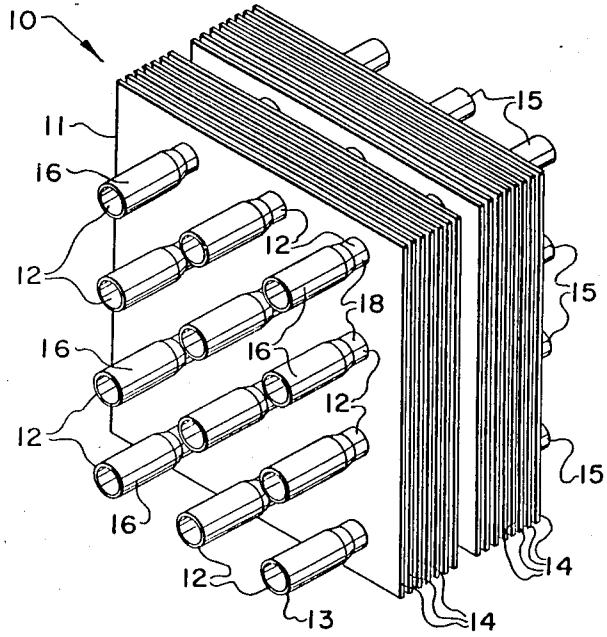
FIG. 1 is a perspective view of a fin and tube heat exchanger core in accordance with the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1 there is illustrated a finned tube type heat exchanger in accordance with the method and apparatus of the present invention and generally designated by the numeral 10. The heat exchanger apparatus 10 is shown as a multi-tube finned heat exchanger core 11 having a plurality of parallel rows and columns of elongated relatively thin walled tubes 12 which extend through a plurality of parallel side by side disposed thin metal fins 14. The core 10 may be configured in various ways to be used in conjunction with headers or tanks, not shown, or the tubes 12 may be interconnected to provide either single or multipass fluid flow circuitry through the core 11. Accordingly, the connections of the opposite ends 13 and 15 of the respective tubes 12 are not shown as the tubes may be suitably connected to other structure in accordance with the desired use of the heat exchanger 10. Those skilled in the art will also recognize that the apparatus and method of the present invention may involve no more than one elongated generally thin walled tube such as a tube 12 used in conjunction with a plurality of fins similar to the fins 14. For example, the tube 12 may be modified for operation as a heat pipe by being closed at both ends and preferably provided with suitable flow separator structure within the interior of the tube as will be described therein in conjunction with FIGS. 6 and 7.

Figure 2:
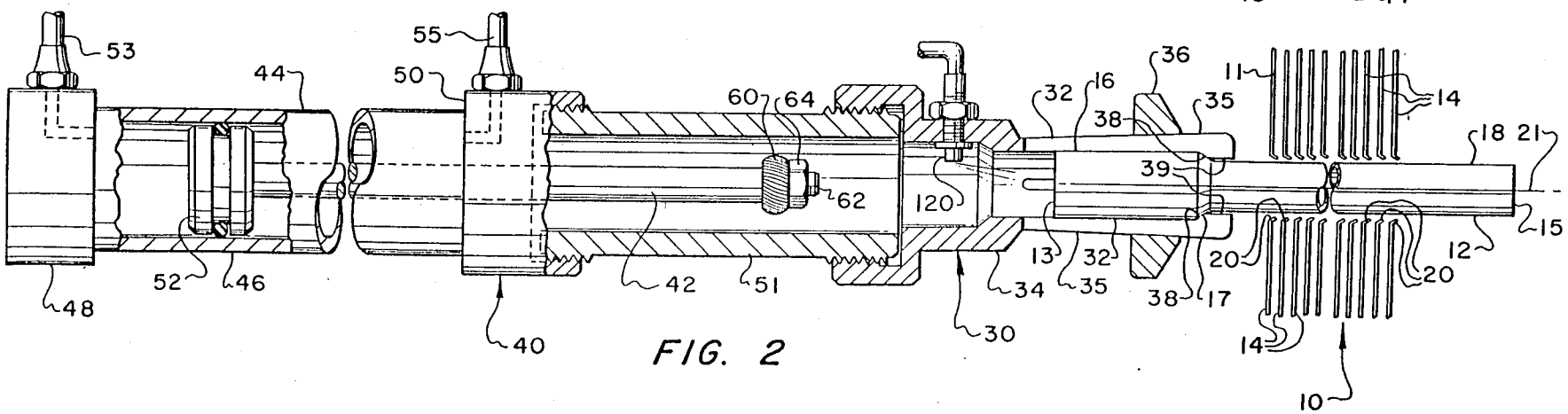
FIG. 2 is a longitudinal elevation, partially sectioned, showing a tube expanding and groove forming apparatus in position to simultaneously expand and groove a heat exchanger tube in accordance with the method of the present invention.
Figure 3:
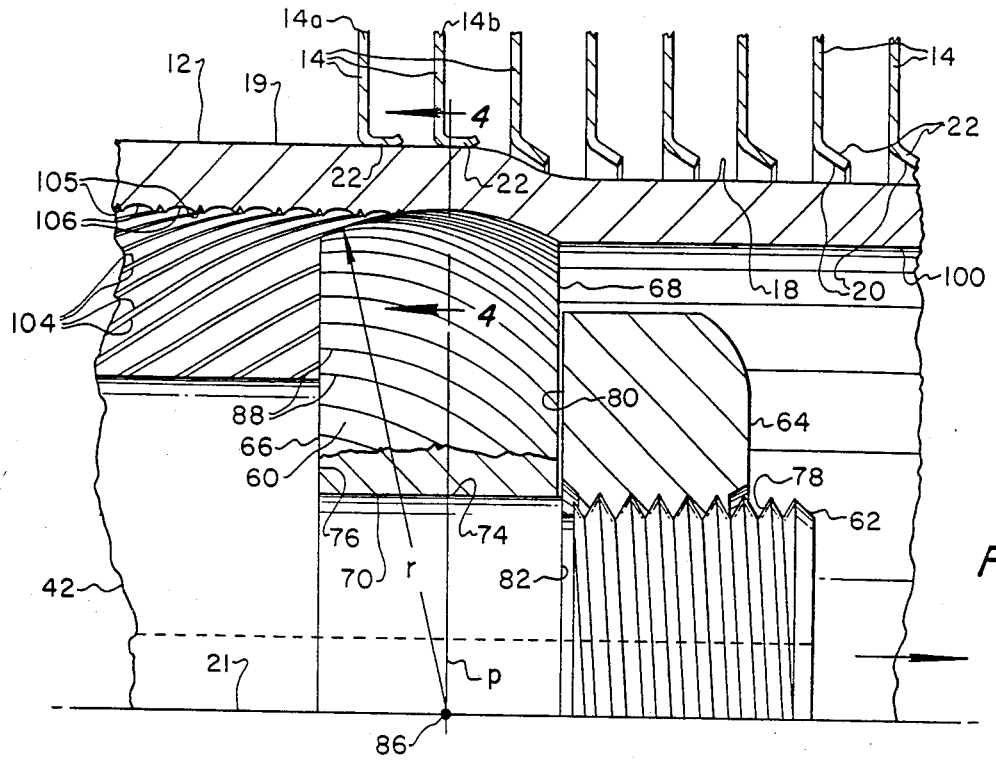
FIG. 3 is a detail section view on a larger scale showing the groove forming and expanding tool in operation to expand and simultaneously form spiral grooves in a tube.

As shown in FIGS. 1 and 2, the portions of the tubes 12 directly adjacent the ends 13 are formed to have an enlarged diameter along a length portion 16 by a conventional upset or expansion process. The remainder of each of the tubes 12, designated by the numeral 18 in FIG. 2, is of uniform diameter and is slightly smaller than the diameters of a plurality of circular openings or perforations 20 formed in the platelike fins 14. The fins 14 may be prefabricated in accordance with a number of techniques wherein the openings 20 are punched or otherwise formed to displace the metal of the fins and form a somewhat circular flange 22 as shown in FIG. 3. The formation of the circular flange 22 around each opening 20 in the fins 14 provides for greater contact area between the outer wall surface 19 of the tubes 12 and the respective fins upon expanding the tubes into contact with the flanges 22 in accordance with the improved process of the present invention.

In providing the expansion and internal grooving of the tubes 12 in accordance with the present invention the heat exchange apparatus is preferably assembled by placing the fins 14 in a suitable fixture, not shown, which will hold the fins aligned with each other and spaced apart the desired distance from each other. The tubes 12 are then inserted through the respective openings 20 in the fins 14 and positioned so that the respective ends 13 and 15 are located properly with respect to their final desired position with respect to the end fin of the fin assembly. At this time the tubes 12 are relatively loosely supported by the fins 14 and projecting through the respective openings 20 in each of the fins. When the tubes 12 have been positioned in the assembly of fins 14 each of the tubes is simultaneously expanded radially with respect to its longitudinal central axis 21 into forcible engagement with the flanges 22 and a unique spiral grooving is formed on the inner wall surface of each of the tubes 12 in accordance with apparatus which will now be described.

Referring to FIG. 2 there is illustrated in somewhat schematic form an apparatus for simultaneously expanding and forming spiral grooving in a tube 12 which is already disposed in assembly with the fins 14 making up the heat exchange apparatus 10. As shown in FIG. 2, the enlarged end diameter 16 of a tube 12 is secured in assembly with an expandable collet mechanism generally designated by the numeral 30. The collet mechanism 30 includes a plurality of radially expandable collet jaws 32 which are formed integral with a generally cylindrical hub portion 34 and have outer axially tapered surfaces 35 engageable with a collet ring 36. The collet jaws 32 are each formed with a reentrant shoulder 38 on the inner sides of the jaws for engagement with a shoulder 17 formed between the expanded portion 16 of the tube 12 and the tube portion 18 of lesser diameter and which extends through the openings 20 in the fins 14. The collet ring 36 is axially slidable on the jaws 32 from the position shown in FIG. 2 toward the hub portion 34 to allow the jaws to expand radially to permit insertion and withdrawal of the tube expanded portion 16. The jaws 32 are relieved radially outwardly at 39 to permit some radial expansion of the tube portion 18 as will be described herein.

The collet mechanism 30 is secured to a tube expanding and groove forming tool 40 comprising an elongated mandrel 42 which is preferably formed as part of the piston rod of a hydraulic double acting cylinder 44. The cylinder 44 is of generally conventional construction comprising a cylinder member 46, opposed head members 48 and 50 and a piston 52 connected to the mandrel 42 and reciprocable in a bore formed by the cylinder member 46. The head 50 is interconnected to the collet hub portion 34 by a suitable adaptor sleeve 51. In response to the introduction of hydraulic fluid into the opposite ends of the cylinder 44 through suitable conduits 53 and 55, respectively, the mandrel 42 may be extended into and through the tube 12 in opposite directions.

The mandrel 42 is adapted to support a unique groove forming tool member or head, generally, designated by the numeral 60, which is mounted on the distal end 62 of the mandrel and constructed so as to be rotatable about the longitudinal central axis of the mandrell but retained thereon by means such as a retaining nut 64. Referring to FIG. 3 also, the tool member 60 comprises a generally convex curved spherical segment or barrel shaped body having spaced apart parallel planar bearing surfaces 66 and 68 and a central bore 70 extending perpendicular to the bearing surfaces 66 and 68 and having a central axis coincident with axis 21. The end 62 of the mandrel 42 is provided with a reduced diameter journal portion 74 and a transverse shoulder 76. The distal end of the journal portion 74 is threaded at 78 for engagement with the nut 64. One transverse face 80 of the nut 64 serves as a bearing surface for engagement with the surface 68 of the tool member 60. The nut 64 is engageable with a shoulder 82 between the threaded portion 78 and the journal portion 74 whereby the tool member 60 is confined between the faces 76 and 80 and is mounted for free rotation on the journal portion 74.

Figure 4:
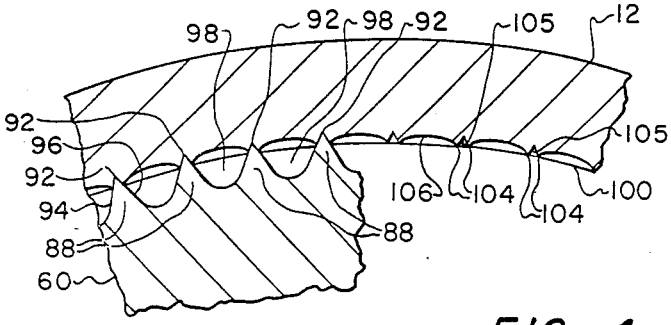
FIG. 4 is a detail section view taken substantially along the line 4—4 of FIG. 3.

The tool member 60 forms a spherical segment having a radius center at 86 coincident with axis 21 and a spherical radius r delimiting the outer periphery of the body of the tool member. The bearing faces 66 and 68 are preferably equally spaced from the radius center 86. The tool member 60 has a plurality of equally spaced longitudinally extending serrations or teeth 88 formed on its spherical periphery which extend between the surfaces 66 and 68 and follow a helix with respect to longitudinal axis 21. Referring briefly to FIG. 4, it will be noted that in a plane perpendicular to the axis 21 the serrations or teeth 88 have a relatively sharp pointed apex 92 and opposed flanks 94 and 96 which form intervening grooves 98. In a preferred embodiment of the tool member 60 the flanks 94 and 96 are inclined toward each other at an included angle of approximately 60°. The teeth 88 also follow a helix angle of approximately 30° with respect to the axis 21. The tool member 60 may be formed from conventional carbide or tool steel materials and the teeth 88 may be ground or cut using various types of tool cutting equipment including helical gear cutting, grinding or hobbing equipment.

In accordance with the improved method of manufacturing the heat exchanger 10 the tool member 60 is forced through the interior of a tube 12 is forcible engagement with the tube bore wall 100, FIGS. 3 and 4, to simultaneously radially expand the tube into engagement with the fins 14 and form parallel spiral ridges 104 which define intervening grooves 105 and 106. The action of forming the ridges 104 by the teeth 88 is not viewed as a cutting action but as a forcible displacement or cold forming process wherein the wall of the tube 12 is simultaneously radially expanded and the material is displaced to form the ridges 104 and the intervening grooves 105 and 106. By forcing the mandrel 42 and tool member 60 through the bore of the tube 12 the tool member 60 is allowed to rotate freely and, upon engagement of the inner bore wall 100 of the tube, forcibly radially displace the wall 100 until the outer wall surface 19 is forcibly engaged with the flanges 22. This action, depending on the amount of displacement and the initial difference in diameter between the outer wall surface of the tube 12 and the openings 20, will result in additional displacement or formation of the flanges 22, as indicated by the tubes **14*a* and 14*b* in FIGS. 3, to insure that forcible engagement is obtained between the outer wall surface 19 and the flanges 22**.

Upon extension of the mandrel 42 into the tube end 13, the tool member 60 will engage the bore wall 100 of the section 18 and radially displace the tube wall while simultaneously displacing material to form the ridges 104 and intervening grooves 105 and 106. Since the tool member 60 is allowed to rotate freely on the mandrel distal end portion 62, the tool will rotate in the direction of the helix formed by the teeth 88 to form the ridges 104 and grooves 105 and 106 having a helix of the same hand and the same helix angle with respect to the longitudinal central axis 21. As the tool member 60 enters the transition between the tube sections 16 and 18 the relief 39 on the collet jaws permits sufficient radial expansion of the tube wall without interference of movement of the tool member 60. The mandrel 42 may be extended until the tool member 60 is forced entirely through the tube section 18 to a point directly adjacent the end 15. The tool member 60 is normally not extended out of the tube end 15 so that the teeth 88 may remain in the grooves 105 which they have formed and whereby the mandrel 42 may be retracted in the opposite direction to allow the teeth 88 to form a secondary or clean up pass through the grooves 105 to remove any metal or smooth over any galling of the surface of the ridges 104. The resistance to movement of the tool member 60 in the reverse direction from tube end 15 toward tube end 13 is not sufficient to overcome the collet gripping force on the end portion 16.

As shown in FIG. 2, a nozzle 120 is supported on the collet hub portion 34 and is directed to the open end of the tube 13 whereby a suitable lubricant may be injected into the interior of the tube during the tube groove forming and expanding process. The mandrel 42 may be suitably modified to include passages for conducting lubricant into the interior of the tube 12 ahead of the tool member 60 as it is pushed through the tube. Alternatively, lubricant may be injected into the opposite end of the tube 12 during the process of extending the mandrel 42 through the tube.

Those skilled in the art will recognize that the tube 12 may be secured by other means during the process of extending the tool member 60 through the tube to simultaneously expand the tube radially and form the ridges 104. For example, the tube may be supported at the end 15 against longitudinal movement as the tool is pushed from the end 13, although it is preferable to support the end of the tube adjacent the point of entry of the tool member 60, so that the tube is loaded in tension during the expanding and grooving process.

Figure 5:
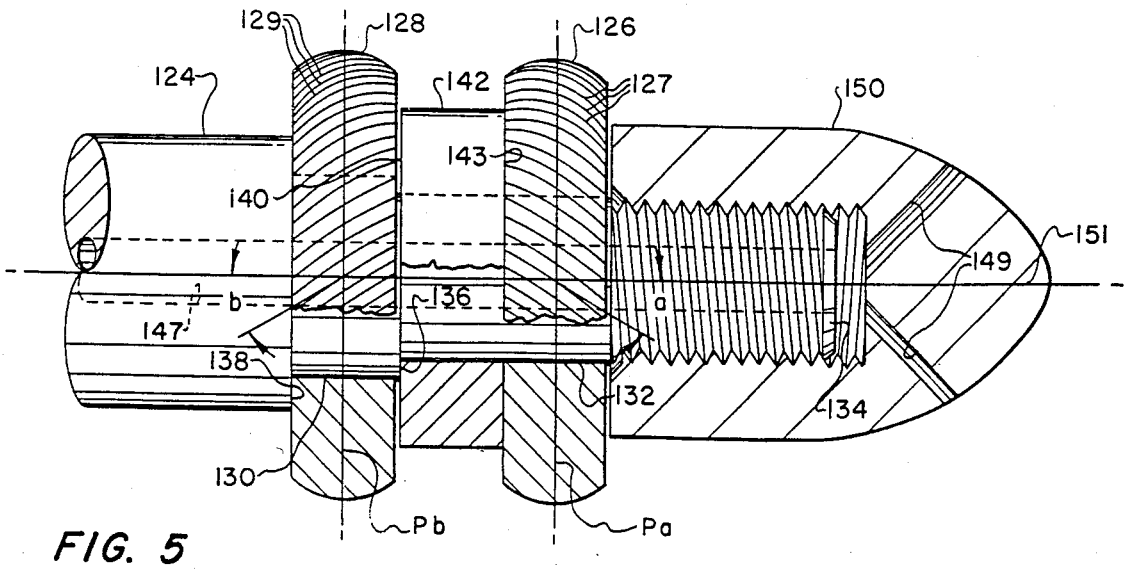
FIG. 5 is a detail view, partially sectioned, of an alternate embodiment of a tube grooving and expanding tool in accordance with the present invention.

Referring now to FIG. 5 there is illustrated a modified mandrel 124 similar to the mandrel 42 but adapted to support for free rotation thereon tool members 126 and 128 similar to the tool member 60 but having respective sets of helical teeth 127 and 129 formed on the spherical surface thereof and being of the opposite hand. The mandrel 124 includes a first cylindrical reduced diameter portion 130, a second cylindrical reduced diameter portion 132 and a threaded distal end 134. The diameter of the mandrel portion 130 is greater than the diameter of the mandrel portion 132 to provide a transverse shoulder 136, and the diameter of the portion 130 is less than the diameter of the main body of the mandrel to provide a second transverse shoulder 138. Lubricant passages 147 and 149 may be provided for conducting a suitable lubricant to the tube interior during the expanding and groove forming process.

Accordingly, the tool member 128 is supported on the reduced diameter portion 130 for free rotation thereon and is operable to bear against the shoulder 138 and against a transverse surface 140 formed on a thrust bearing 142. An opposite transverse face 143 of the thrust bearing 142 forms a bearing surface for the tool member 126. The tool members 126 and 128 are retained on the end of the mandrel 124 by an elongated somewhat bullet shaped nut 150 which assists in guiding the tool members through a tube such as the tube 12 when the tube is relatively free and unsupported by any other structure. The tool arrangement illustrated in FIG. 5 is adapted to form ridges in the bore wall of a tube similar to the ridges 104 but comprising two sets of helical ridges of the opposite hand to, in effect, form a diamond shaped knurl on the inner bore wall of a tube.

FIG. 5 illustrates the configuration of the teeth 127 and 129 as being parallel to lines having helix angles a and b, respectively. The helix angles a and b are defined with respect to a central axis 151 at the intersections of planes $P_a$ and $P_b$ which are normal to the axis 151 at the maximum radius of the curved outer surfaces of the teeth.

Those skilled in the art will recognize from the foregoing description that a unique heat exchanger apparatus and a method of a manufacturing same has been provided in accordance with the present invention. The simultaneous expanding of the tubes 12 and forming spiral ridges and grooves on the inner wall surface of the tubes shortens the time required to manufacture a heat exchanger apparatus of the type described and also provides improved means for enhancing heat exchange between the fluid flowing through the tube and the exterior of the tube.

In accordance with the present invention it is contemplated that most of the conventional engineering materials used in the manufacture of heat exchanger apparatus of the general type described may be effectively worked with the tooling described herein in accordance with the method of the invention. One advantage of the present invention is that the working of the inner wall of the tube to form the ridges 104, for example, somewhat strengthens the tube even though the wall thickness is reduced during the expansion process. Accordingly, it has been determined that tubes having an initially thinner wall thickness can be used as compared with tubing wherein expansion alone of the tube wall was carried out to form the connection between the tubes and the heat exchange fins. For example, in the fabrication of a heat exchanger utilizing copper tubing of 0.625 inches outside diameter it has been determined that tubes 12 having a wall thickness of about 0.028 inches may be used as compared with a wall thickness of 0.049 inches for prior art expanded tubes. In the formation of a tube having the dimensions described hereinabove the tool member 60 is provided with sixty-four equally spaced teeth 88 having a helix angle of 30° with respect to the axis 21 at the point of intersection of a plane P perpendicular to the axis 21 and passing through the radius center 86, as indicated in FIG. 3. The teeth 89 are configured to form a ridge 104 having an overall depth of approximately 0.006 inches from the peak of the ridge to the bottom of the grooves 105. A tool member 60 for working a tube with the abovementioned dimensions of outside diameter and a wall thickness of 0.049 inches preferably has a maximum diameter of approximately 0.55 inches and the teeth 88 have a radial height of 0.023 inches.

Although the apparatus and method of the present invention have been described herein in conjunction with a specific type of heat exchanger apparatus 10 it will be understood that the tubes 12 may be utilized in other applications. For example, a single tube 12 may be expanded and grooved to form the ridges 104 with or without assembly to a set of a heat exchange fins such as the fins 14. The tube 12 may be closed at both ends and provided with suitable flow separator structure within its interior after the ridge and groove forming process and filled with a heat exchange fluid to form a heat pipe. Moreover, the provision of the spiral ridges or grooving may be useful in many different types of fluid conducting tubes used in various heat exchange applications.

Figure 6:
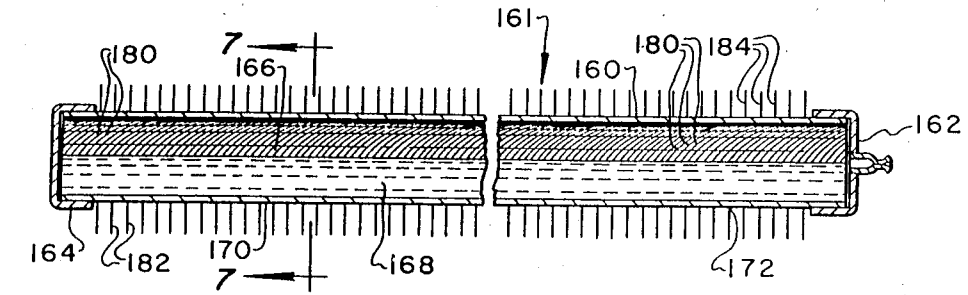
FIG. 6 is a longitudinal central section view of a spiral grooved heat pipe fabricated in accordance with the present invention.
Figure 7:
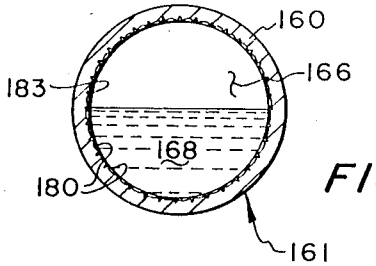
FIG. 7 is a section view taken along line 7—7 of FIG. 6.

Referring now to FIGS. 6 and 7, there is illustrated a heat exchange apparatus comprising an elongated cylindrical thinwalled tube 160 comprising a heat pipe 161. The tube 160 is closed at its opposite ends by end cap structures 162 and 164 to form an elongated interior closed chamber 166 within the tube which is provided with a quantity of condensable fluid 168 which may be used to transfer heat from an evaporator section 170 to a condenser section 172. The heat pipe 161 is provided with a series of parallel helical ridges 180 and intervening grooves substantially like the ridges 104 and the grooves 105 and 106 formed in the tubes 12 and formed on the inner wall surface 183 of the tube 160 using a tool identical or similar to the tool member 60. The ridges 180 and the intervening grooves formed thereby extend circumferentially around the inner wall surface 183 and may extend longitudinally from substantially one end of the heat pipe 161 to the opposite end. In this way a low impedance thermal path is provided between the interior chamber 166 and the exterior surface of the tube 160 and capillary action imposed on the fluid flowing between the evaporator and condenser sections is enhanced. The heat pipe 160 may, of course, be provided with plural heat transfer fins 182 and 184 formed on the respective evaporator and condenser sections 170 and 172 and secured to the tube 160 in the same manner as the fins 14 are secured to the tubes 12. The advantages of utilizing a tube with a reduced wall thickness and the provision of the reduced resistance to fluid flow and heat transfer provided by the helical ridges 180 may thus be enjoyed in a heat transfer apparatus of the type described in conjunction with FIGS. 6 and 7 also.

Although preferred embodiments of the invention have been described herein those skilled in the art will recognize that various substitutions and modifications may be made to the specific embodiments without departing from the scope and spirit of the invention as recited in the appended claims.

What is claimed is:

1. A method of manufacturing a heat exchanger apparatus comprising at least one elongated relatively thinwalled fluid conducting tube, comprising the steps of:

providing a tool comprising a convex curved tool member having a plurality of helical teeth formed on the peripheral curved surface of said tool member, said tool member being constructed for support on a mandrel for forcible traversal through at least a portion of said tube;

traversing said tool member through said tube in one direction while rotating said tool member relative to said tube to form a plurality of substantially continuous helical ridges and intervening grooves in the inner cylindrical wall of said tube; and providing a second tool on said mandrel having a plurality of teeth formed thereon for forming grooves in said ridges having a helix angle other than the helix angle of said ridges and intervening grooves.

* * * * *